US006637871B1

(12) United States Patent
Martin et al.

(10) Patent No.: US 6,637,871 B1
(45) Date of Patent: Oct. 28, 2003

(54) DROPLET GENERATOR FOR A CONTINUOUS STREAM INK JET PRINT HEAD

(75) Inventors: Graham D Martin, Sawston (GB); Nigel E Sherman, Woolpit (GB); Sukbir S Pannu, Grantchester (GB); Andrew D King, St. Ives (GB)

(73) Assignee: VideoJet Technologies, Inc., Wood Dale, IL (US)

( * ) Notice: Subject to any disclaimer, the term of this patent is extended or adjusted under 35 U.S.C. 154(b) by 0 days.

(21) Appl. No.: 10/030,671

(22) PCT Filed: Jul. 7, 2000

(86) PCT No.: PCT/GB00/02619

§ 371 (c)(1),
(2), (4) Date: May 16, 2002

(87) PCT Pub. No.: WO01/03933

PCT Pub. Date: Jan. 18, 2001

(30) Foreign Application Priority Data

Jul. 14, 1999 (GB) ..... 9916532

(51) Int. Cl.[7] ..... B41J 2/025; B41J 2/02
(52) U.S. Cl. ..... 347/73; 347/75
(58) Field of Search ..... 347/47, 48, 73, 347/77, 74, 75

(56) References Cited

U.S. PATENT DOCUMENTS 4,095,232 A 6/1978 Cha
4,210,920 A 7/1980 Burnett et al.
4,544,930 A * 10/1985 Paranjpe ..... 347/77
4,660,058 A * 4/1987 Cordery ..... 347/48
4,685,185 A 8/1987 Boso et al.

FOREIGN PATENT DOCUMENTS

| | | |
|---|---|---|
| EP | 0 389 738 | 10/1990 |
| JP | 05330062 | 12/1993 |
| JP | 07148930 | 6/1995 |
| WO | WO 95/25637 | 9/1995 |
| WO | WO 96/31289 | 10/1996 |
| WO | WO 98/51503 | 11/1998 |

* cited by examiner

*Primary Examiner*—Anh T. N. Vo
(74) *Attorney, Agent, or Firm*—Kirschstein et al.

(57) ABSTRACT

A droplet generator for a continuous stream ink jet print head includes an elongate cavity for containing the ink, nozzle orifices in a wall of the cavity for passing ink from the cavity to form jets. The nozzle orifices extend along the length of the cavity. An actuator is disposed on the opposite side of the cavity to the wall for vibrating the ink in the cavity by itself vibrating relative to the wall. The vibration is such that each jet breaks up into ink droplets at the same predetermined distance from the wall of the cavity. The thickness of the wall through which the nozzle orifices extend is less than 90 $\mu$m. The wall includes a planar member secured to the remainder of the droplet generator so as to form a boundary which extends around the nozzle orifices and within which the planar member is unsupported. The boundary includes first and second boundary lengths which extend along the length of the cavity on either side of the nozzle orifices. The distance between the first and second boundary lengths being less than 1700 $\mu$m.

9 Claims, 7 Drawing Sheets

DROPLET GENERATOR FOR A CONTINUOUS STREAM INK JET PRINT HEAD

BACKGROUND OF THE INVENTION

This invention relates to a droplet generator for a continuous stream ink jet print head.

More particularly the invention relates to such a generator comprising: an elongate cavity for containing the ink; nozzle orifices in a wall of the cavity for passing ink from the cavity to form jets, the nozzle orifices extending along the length of the cavity; and actuator means disposed on the opposite side of said cavity to said wall for vibrating the ink in the cavity by itself vibrating relative to the wall, the vibration being such that each jet breaks up into ink droplets at the same predetermined distance from the wall of the cavity. Droplet generators of the aforegoing type will hereinafter be referred to as droplet generators of the specified type.

In order to enable generators of the specified type to be used with corrosive (non-aqueous based) ink, certain known such generators are constructed predominantly of stainless steel components. One such component is the wall containing the nozzle orifices, and takes the form of a thin sheet of stainless steel foil through which the orifices extend.

The orifices have to be comparatively small and of very high quality. This is so that the jets produced by the orifices are identical. They must be parallel to one another to fractions of a degree, and have equivalent velocities to within a few percent. This requires perfectly round holes with relative sizes to within 5 percent. There are few fabrication techniques that can achieve this requirement in stainless steel. All techniques suffer and encounter increasing difficulty as the thickness of the foil increases. The superior technique evolved is electro discharge machining (EDM).

In such an orifice formation process a thin metal wire or electrode is brought to within close proximity of the foil. A voltage is applied across the gap and as arcing occurs between the foil workpiece and the electrode local heating results in vaporisation and expulsion of the foil material. In order to achieve holes of the required quality very low current is applied. This improves the finish of the holes but increases the time required to 'drill' each hole, and hence complete the drilling of the full array of holes/orifices. In a 128 dots per inch (DPI) printer having a 50 mm long line of 256 holes, each extending through foil 100 $\mu$m thick, the drilling time amounts to 12–13 hours. This time is considerable and has significant production implications with respect to both unit cost and capacity.

The measure of an ink jet printer's ability to print on distant substrates is termed the 'throw' of the printer. A high throw is necessary when printing on uneven substrates or in conditions where there is significant air turbulence in the region of the jets. Throw is related to jet velocity. Jet velocity equals wavelength multiplied by frequency. Vibration of the actuator means at the frequency of operation of the generator produces an ultrasonic wave which travels down the jets. This wave is clearly visible in the jets under suitable magnification, and enables wavelength and therefore jet velocity to be measured. For a given frequency of operation, wavelength can be used as a measure of jet velocity and hence throw of a printer. It can be seen that at a given frequency of operation it is desirable to maximise jet wavelength to maximise throw.

In a known ink jet printer, having a standard 128 DPI nozzle produced in 100 $\mu$m thick stainless steel foil, when using methylethylketone ink, the operating range of wavelengths is 155 to 165 $\mu$m, giving a mean operating wavelength of 160 $\mu$m representing a jet velocity of 12 m/s.

SUMMARY OF THE INVENTION

According to the present invention there is provided a droplet generator for a continuous stream ink jet print head comprising: an elongate cavity for containing the ink; nozzle orifices in a wall of said cavity for passing ink from the cavity to form jets, said nozzle orifices extending along the length of said cavity; and actuator means disposed on the opposite side of said cavity to said wall for vibrating the ink in said cavity by itself vibrating relative to said wall, the vibration being such that each said jet breaks up into ink droplets at the same predetermined distance from said wall of the cavity, the thickness of said wall through which said nozzle orifices extend being less than 90 $\mu$m, said wall comprising a planar member secured to the remainder of said droplet generator so as to form a boundary which extends around said nozzle orifices and within which said planar member is unsupported, said boundary including first and second boundary lengths which extend along the length of said cavity on either side of the nozzle orifices, the distance between said first and second boundary lengths being less than 1700 $\mu$m.

Preferably, the distance between said first and second boundary lengths is less than 1350 $\mu$m.

Preferably, said planar member is a planar metallic member, e.g. stainless steel foil. Preferably, said planar metallic member is secured to the remainder of said droplet generator by means of welding, the path taken by the welding defining said boundary around the nozzle orifices. Preferably, the nozzle orifices have been formed in said planar metallic member by electro discharge machining.

Preferably, said thickness of said wall through which said nozzle orifices extend is greater than 45 $\mu$m, more preferably greater than 55 $\mu$m, even more preferably from 60 to 80 $\mu$m.

BRIEF DESCRIPTION OF THE DRAWINGS

A droplet generator in accordance with the present invention will now be described, by way of example, with reference to the accompanying drawings, in which.

DETAILED DESCRIPTION OF THE PREFERRED EMBODIMENTS

Figure 1:
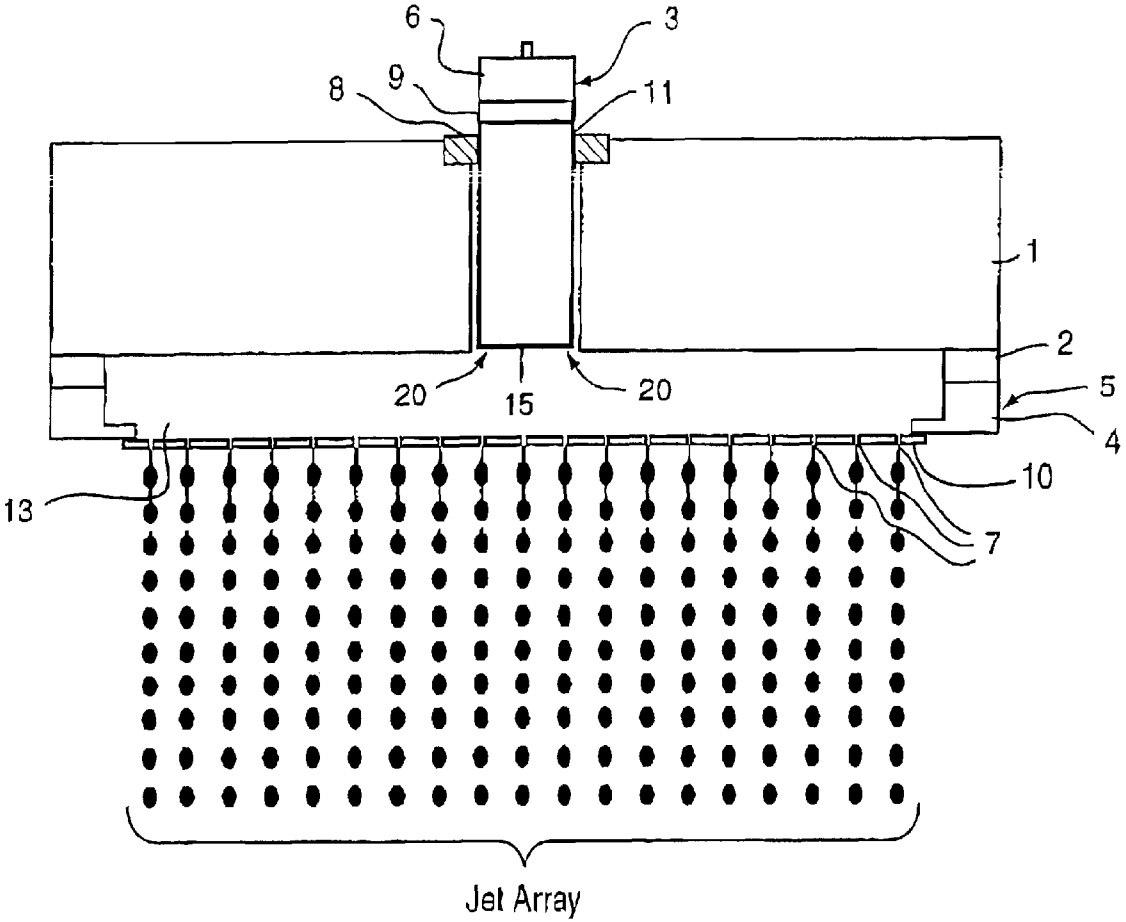
FIG. 1 is a front view of the generator.
Figure 2:
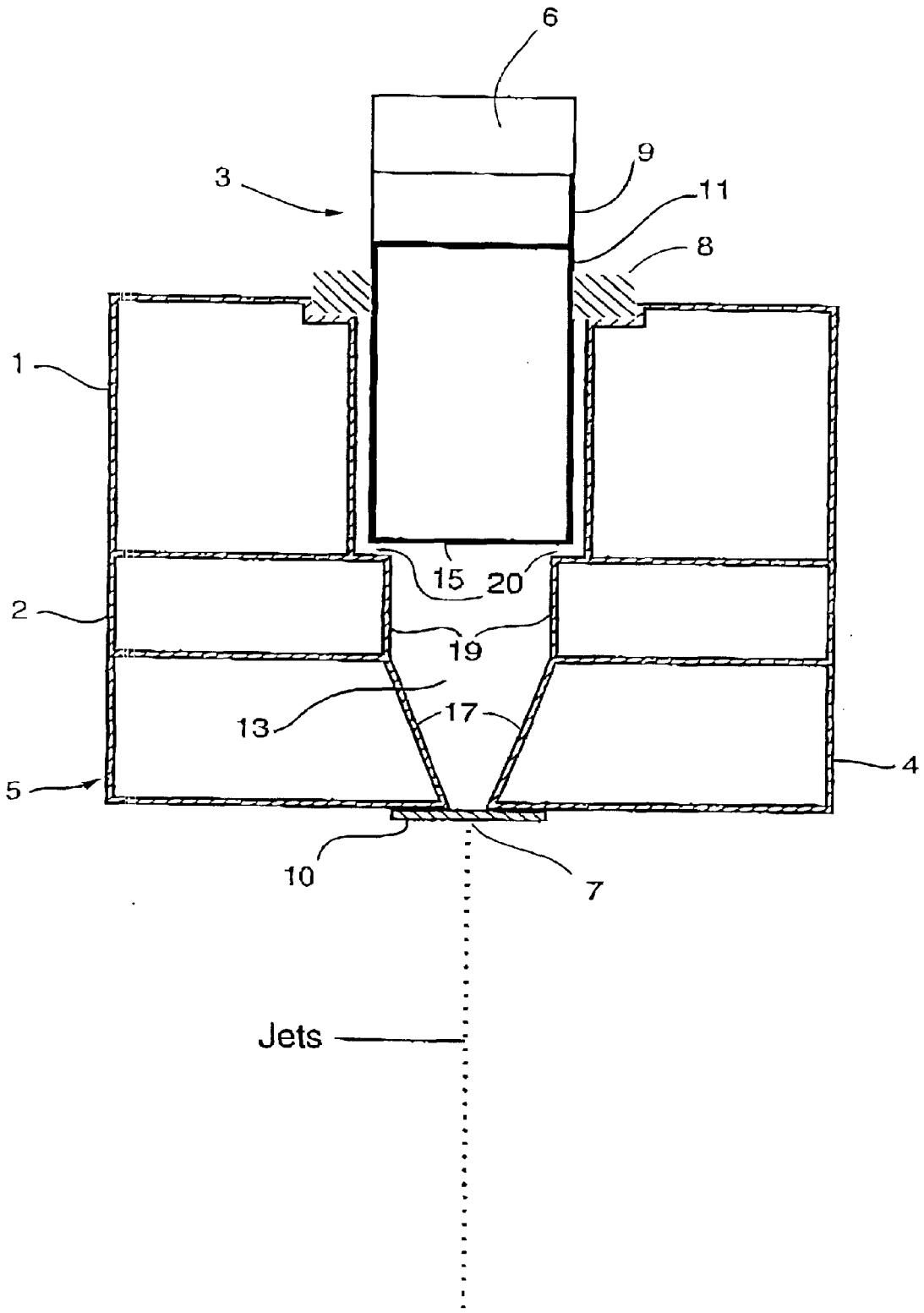
FIG. 2 is a side view of the generator of FIG. 1.
Figure 3:
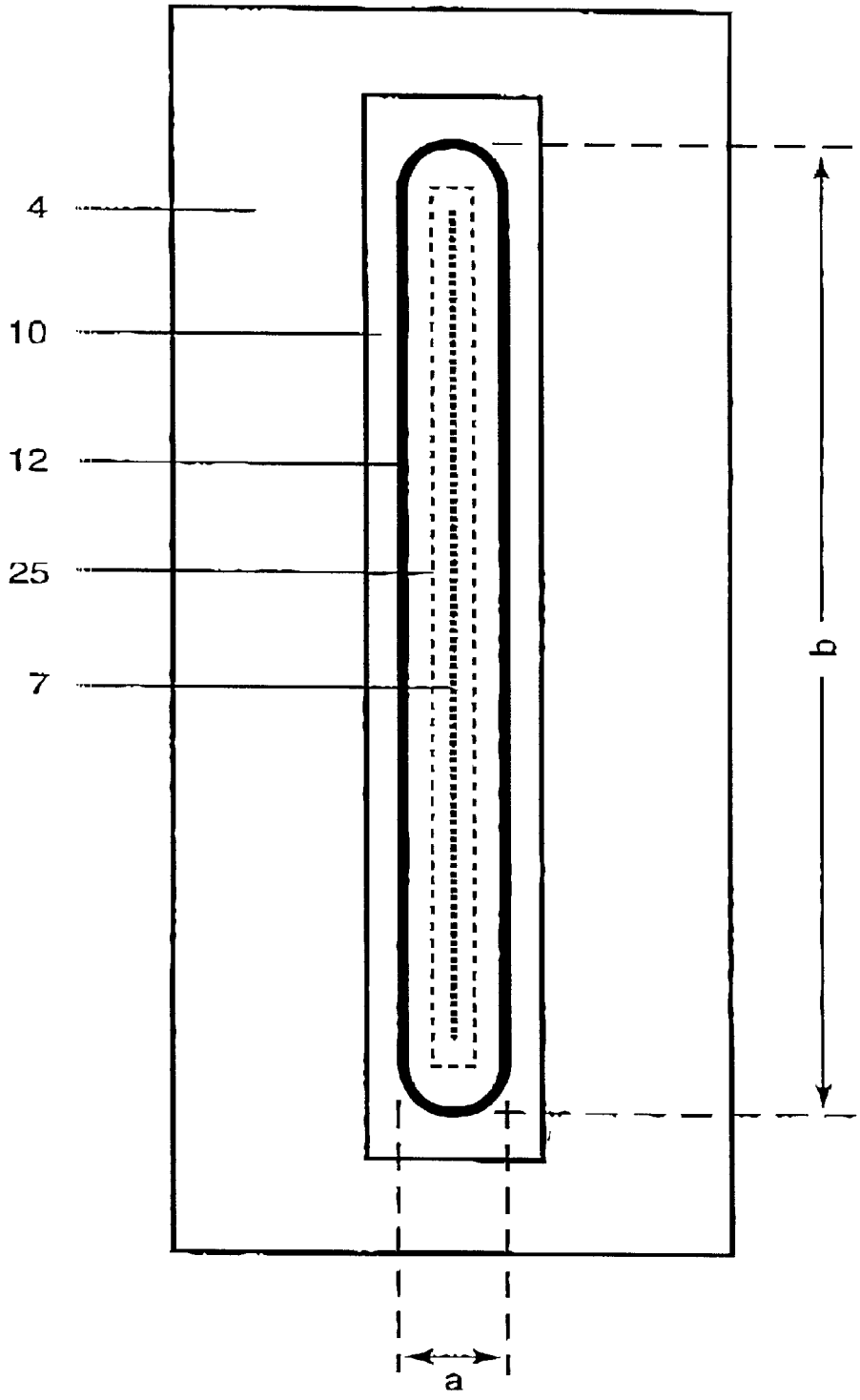
FIG. 3 is an underneath view of the generator of FIG. 1.

Referring to FIGS. 1 to 3, the generator comprises a stainless steel manifold 1, a stainless steel spacer 2, an actuator 3 and a stainless steel nozzle carrier 5. Actuator 3 comprises a piezoelectric driver 9, a stainless steel head 11 and a brass backing member 6, and is held within manifold 1 by means of a compliant element 8. Piezoelectric driver 9 is driven by means of a single electrical connection to brass backing member 6 and the earthing of steel head 11. Nozzle carrier 5 comprises a stainless steel element 4 defining therein a 'V' cross section channel, and secured to element 4, a stainless steel foil sheet 10. Sheet 10 contains a line of nozzle orifices 7, and is so secured to element 4 that this line runs along the length of the open apex of the 'V' cross section channel of element 4. Manifold 1, spacer 2 and nozzle carrier 5 are bolted together. Foil sheet 10 is welded to nozzle carrier 5. FIG. 3 shows the path 12 of the weld. Since practically all adhesive based bonding techniques are incompatible with the use of corrosive ink, the absence of such bonding techniques in the generator enables the use, if desired, of such ink. It is to be noted that due to the thickness of foil sheet 10 (see later), it is not possible to diffusion bond or braze sheet 10 to carrier 5, since such techniques would cause unacceptable distortion of sheet 10.

An elongate ink cavity 13 is defined by the lower face 15 of actuator 3 and interior faces 17, 19 of element 4 and spacer 2. A narrow gap 20 is present on either side of head 11 of actuator 3 between it and manifold 1. 'O' rings (not shown) just below compliant element 8 seal against the further eggression of ink from cavity 13 and gaps 20. Thus, piezoelectric driver 9 is sealed from contact with the ink. Channels (not shown) are provided in manifold 1 and communicate with gaps 20 for the supply of ink to cavity 13 and the bleeding of air/ink from cavity 13.

At the frequency of operation of the generator, cavity 13 has a resonant frequency at which ink within cavity 13 immediately adjacent the line of nozzle orifices 7 vibrates in phase and with the same amplitude in a direction perpendicular to the plane of foil sheet 10 containing nozzle orifices 7. Thus, the vibration of the ink in cavity 13 is such that each ink jet breaks up into ink droplets at the same predetermined distance from its respective nozzle orifice 7.

It is a requirement for proper operation of the generator that there be comparatively low communication of the vibration of actuator 3 to other generator structure on the boundary of ink cavity 13. Indeed, the design intent is that actuator 3 execute a piston like motion within the surrounding stationary structure of the generator. The foregoing leads to the requirement that the frequency of excitation applied to actuator 3 must be sufficiently distant from resonant frequencies of foil sheet 10. The droplet generator is designed to operate at a frequency sufficiently below the first resonance mode of foil sheet 10.

Figure 4:
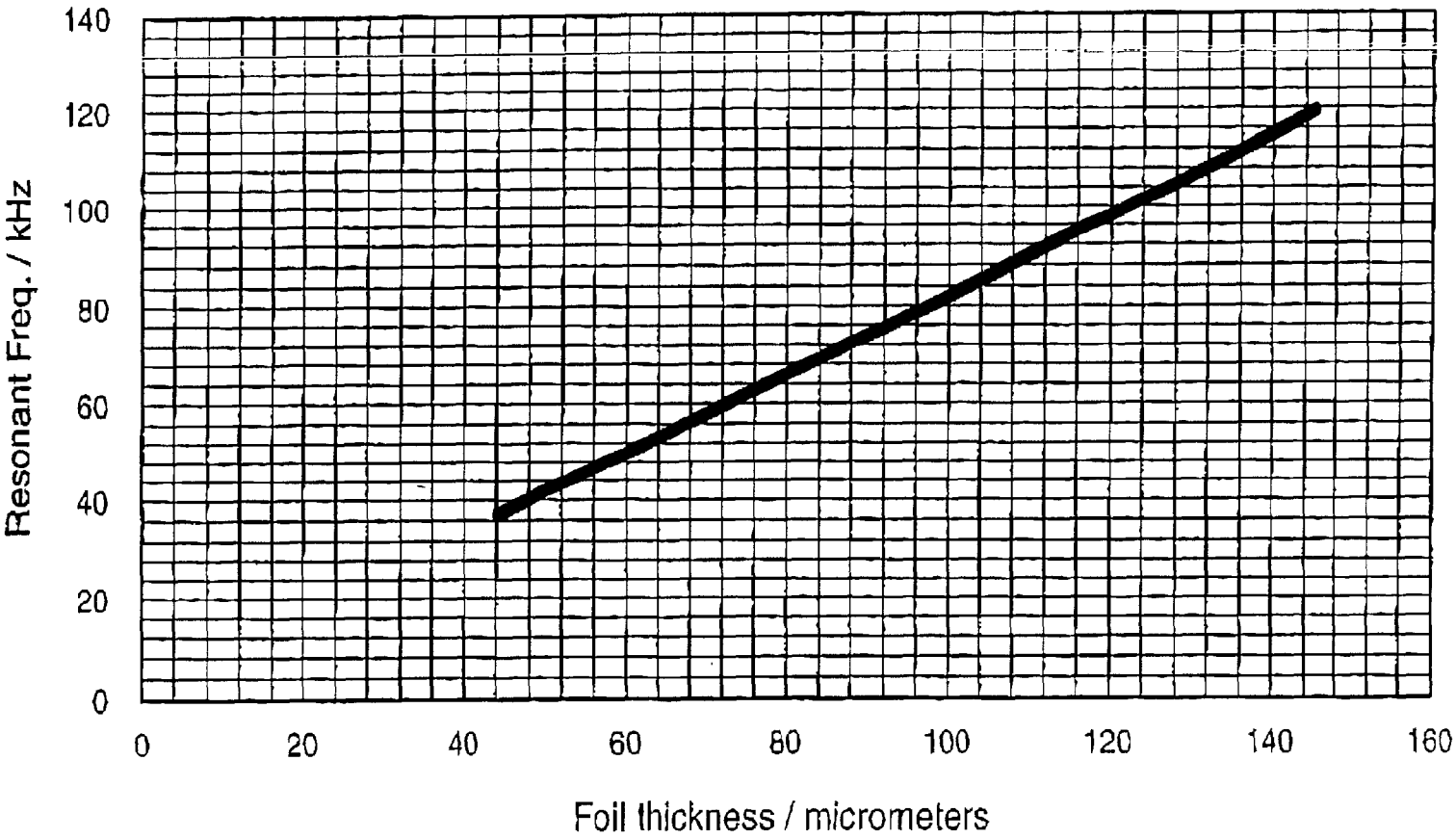
FIG. 4 is a graph of resonant frequency vs. thickness of a nozzle orifice foil sheet of the generator of FIG. 1.

The frequency of this first resonance mode is related to the thickness of sheet 10. Reference is to be made here to the graph of FIG. 4. The thicker foil sheet 10 the higher its first resonant frequency. Droplet generators capable of operating at high frequencies of excitation allow fast print speeds, an important and desirable characteristic. Thus, in a given droplet generator there is a limit on the minimum thickness of foil sheet 10 for a given operating frequency.

It is possible to overcome this limit on the thickness of foil sheet 10 by modifying the geometry of the attachment of sheet 10 to nozzle carrier 5 as will now be explained.

Figure 5:
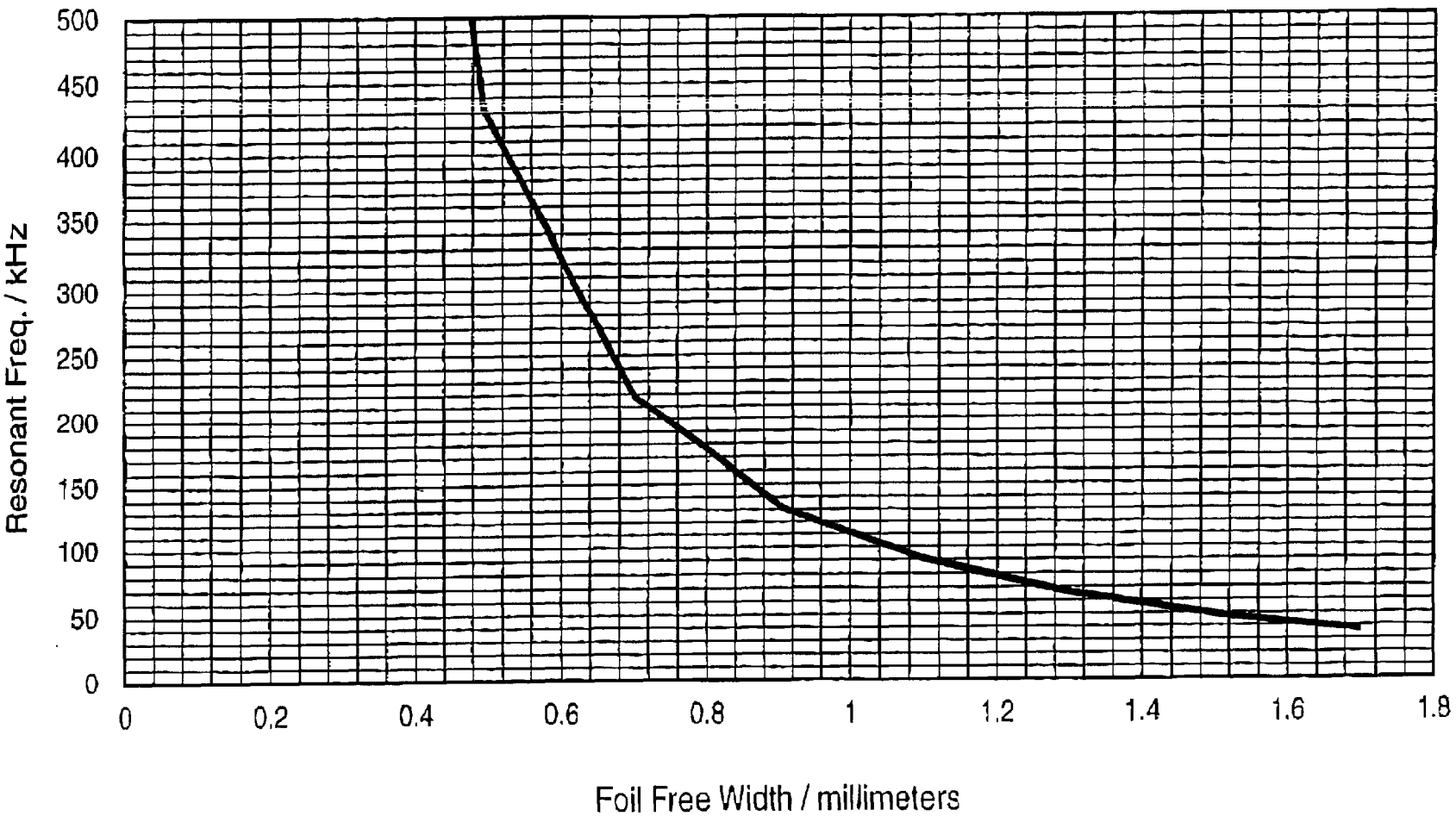
FIG. 5 is a graph of resonant frequency vs. free unsecured width of the foil sheet of the generator of FIG. 1.

Foil sheet 10 is secured to nozzle carrier 5 along weld path 12. The region of sheet 10 inside weld path 12 is unsupported except for its boundaries with the weld. This forms a long thin sliver of unsupported foil. The width of this sliver is defined as the foil free-width a (see FIG. 3). Mathematical analysis of foil resonance shows that the frequency of the foil's first resonance mode is related not only to the thickness k of the foil, but also to the width a and length b of the sliver of unsupported foil. Resonant frequency $F=(c/2).(\text{sqrt}((n^2/a^2)+(m^2/b^2)))$, where n and m are mode numbers, and c is wave speed and is given by $c=w^{1/2}$, where w is the pulsatance, E is Young's modulus, v is Poisson's ratio, and p is density. Thus, it will be seen that the narrower the foil free width a the higher the resonant frequency. Reference is to be made here to the graph of FIG. 5 (drawn for a foil 45 $\mu$m thick).

Figure 6:
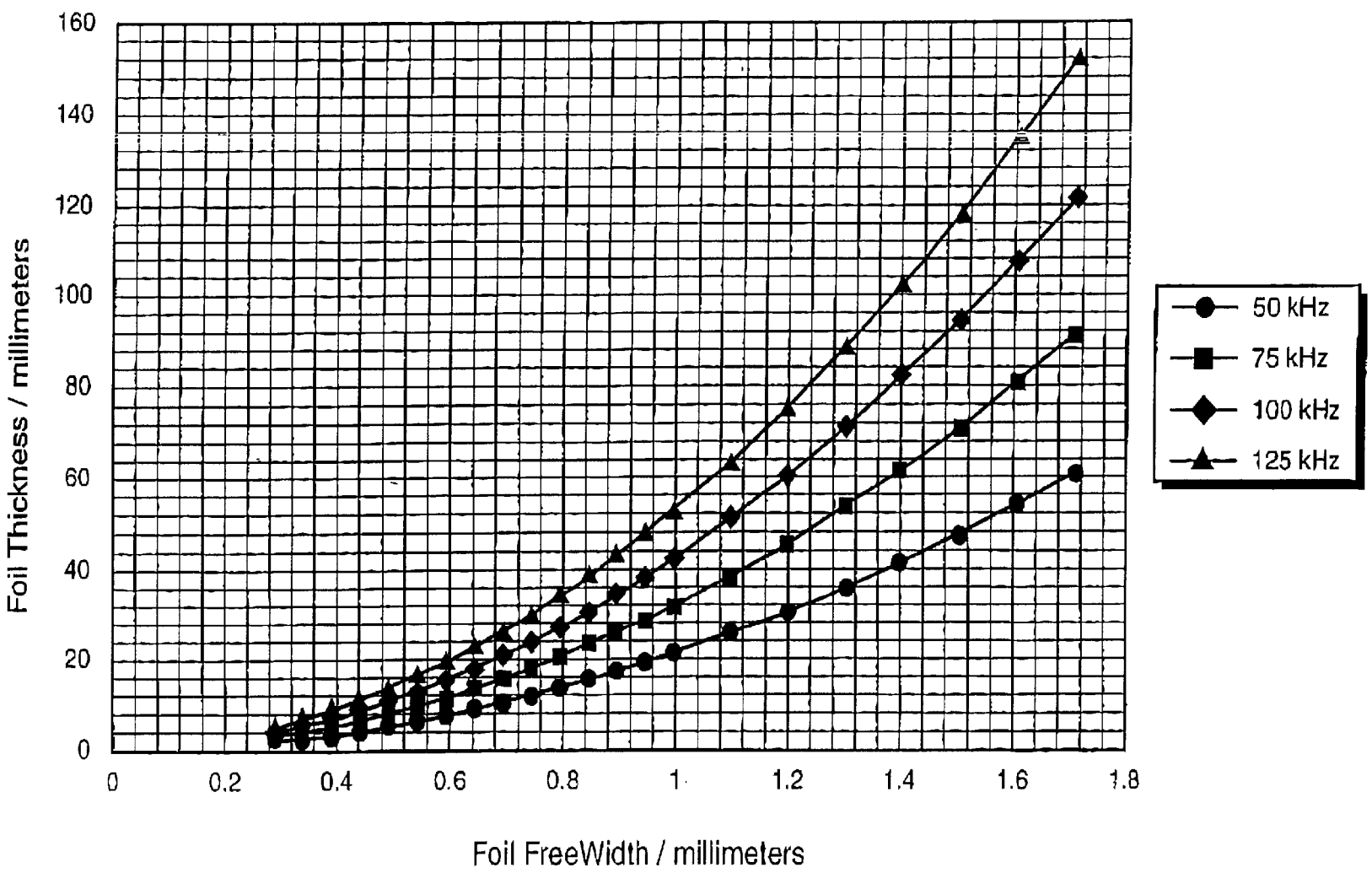
FIG. 6 is a graph of thickness vs. free unsecured width of the foil sheet of the generator of FIG. 1, showing the combinations of thickness and unsecured width which give rise to resonance of the foil sheet at four different frequencies.

The aforegoing analysis reveals that it is possible to work with foils thinner than previously thought possible, by modifying the geometry of the attachment of the foil to the nozzle carrier, specifically by modifying the foil free width a. Reference is to be made here to the graph of FIG. 6. In the graph four curves are plotted each representing an operating frequency (50, 75, 100, 125 kHz) of the generator, and hence each representing a foil resonance frequency to be avoided by the choice of an appropriate foil thickness and width according to the graph. In the graph, for each operating frequency, the region of foil thickness/width combinations well above and well to the left of the line representing the frequency are acceptable thickness/width combinations. It is to be noted that as the frequency of operation decreases, the size of the region of acceptable thickness/width combinations increases. Thus, it will be seen that, dependent on the frequency of operation, there is an infinite number of foil thickness/width combinations that can be chosen to avoid foil first mode resonance problems.

In continuous array ink jet printing one design aim is that the jets be 'satellite' free, i.e. that the 'proper' droplets of each droplet stream are not interposed with much smaller so called satellite droplets. Also, as already stated, it is required that each jet break up into droplets at the same predetermined distance from its respective nozzle orifice. It has been found that the thinner the foil sheet 10 the higher the wavelength required to best meet these two criteria. Since, as explained previously, for a given frequency of operation, wavelength can be used as a measure of printer throw, it can be seen that the consequence of reducing the thickness of foil sheet 10, is to increase printer throw.

The thinner foil sheet 10 the less time taken to drill the line of nozzle orifices 7 using EDM. EDM is a high quality but comparatively slow machining process. Due to material clearance requirements, the EDM process becomes slower as hole depth increases. In general drilling time is related to the square of the drilling depth, i.e. if drilling depth is increased by a factor of sqrt 2, drilling time is doubled. It will be apparent that even a small reduction in the thickness of foil sheet 10 confers a significant gain in terms of orifice drilling time.

Jet misdirection is an expression used to describe the case where ink jets emanate from nozzle orifices 7 in directions other than intended. Jet misdirection is related to the thickness of foil sheet 10. Thicker foils tend to offer better jet directionality since any lack of uniformity in flow entering an orifice tends to be corrected by the orifice itself as the flow travels along its length. The boundary layer of flow immediately adjacent the orifice wall grows in thickness downstream of entry into the orifice and eventually forms a fully developed flow, somewhat independent of input conditions. Jet directionality is key to high quality prints. Any small misalignments between jets causes imperfections in print samples that can be unacceptable.

Figure 7:
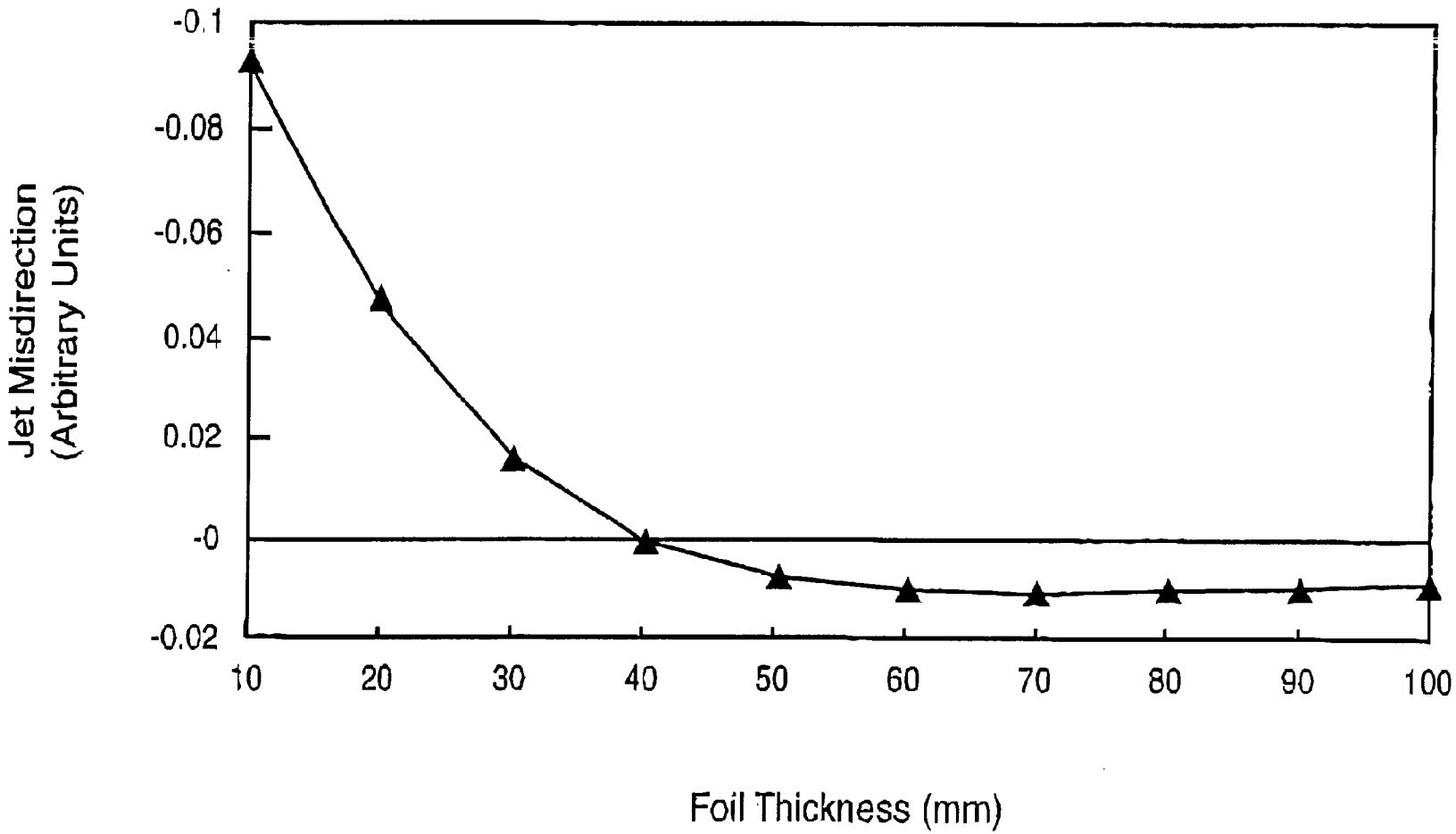
FIG. 7 is a graph of ink jet misdirection vs. foil sheet thickness of the generator of FIG. 1.

Finite element analysis modelling work suggested that the relationship between good jet directionality and foil thickness was a non-linear one. It appeared to asymptote rapidly towards skewed jet arrays at low foil thickness. The susceptibility of a jet to a given flow irregularity was investigated and showed that, for the flow conditions in a typical continuous array ink jet print head, the jet direction error asymptotes to zero near 100 $\mu$m in foil thickness. The degradation in jet array quality due to any reduction in foil thickness would therefore be gradual near 100 $\mu$m and increase rapidly as the foil thickness approaches zero. Reference is to be made here to the graph of FIG. 7. There appeared to be a breakpoint at around 45 μm foil thickness. This suggests that by working above 45 μm minimal reduction in print quality due to jet misalignment effects would be experienced.

Comment will now be made regarding issues associated with welding of foil sheet 10 to nozzle carrier element 4.

Welding as a process has distortion issues associated with thin foils. The heat generated by the welding process must not be allowed to deform the bulk of the foil as these deformations will affect subsequent jetting. Further, the welding process requires good contact between the foil and the nozzle carrier, and distortion compromises this. In general the welding of thinner foils is limited due to its greater susceptibility to these heating effects.

The foil is welded accross a thin (300 μm) slot in the stainless steel nozzle carrier. The slot is defined by the aforementioned open apex of the 'V' cross section channel of element 4 of nozzle carrier 5, and is labelled 25 in FIG. 3. The slot is made as narrow as possible but must be wide enough to offer little disturbance to ink entering the nozzle holes. The turbulence associated with the flow along the edge of the slot and the slot/foil interface can cause jet directionality problems. The foil welding process is critical to this. It requires good contact between the foil and the nozzle carrier and uniform heat dispersion from the foil into the carrier. This tends to restrict the minimum distance permissible between the weld path and the edge of the slot. These difficulties restrict the position of the weld beads holding the foil to the carrier and limit the minimum free unsecured width of the foil. The welding process has the tendency to produce dross and debris. The region of the foil near the holes has to be kept clear of this debris or again directionality problems can occur. The closer the weld to the nozzle holes, the greater the risk of dross associated problems.

It will be seen from the foregoing that welding associated issues place a limitation on the minimum thickness of the foil and the minimum foil free width. Obviously, the quality of the welding process used in a given case is relevant to the determination of the particular limits on foil thickness and foil free width in that given case.

In the light of the above analyses/understandings, a range of thicknesses of foil sheets 10 were tried in the droplet generator of FIGS. 1 to 3. The range tried was 45, 55, 65, 75, 85, 95 and 100 μm, and in the case of each thickness the foil free width used was 500 μm. The foils were drilled with standard 128 DPI holes. Drilling times for thinner foils were significantly quicker. In particular, 65 μm foil drilling times were 5–6 hours compared with 12–13 hours for 100 μm foil. The thinner foil nozzles were jetted under a variety of conditions. These included a range of wavelengths, print heights and print speeds. It was found that although the jet straightness and subsequent drop positioning did suffer with reduced foil thickness the effects were only really apparent in 45 μm foils. Due to foil resonance problems, foils at 55 μm thickness and thinner failed to produce uniform jet break-off across the jet array, in conditions acceptable to thicker foils. Nozzles which satisfied this criteria, 65 μm and thicker, were run at a range of wavelengths with solvent based ink. In particular, the arrays were assessed by their ability to satisfy the satellite free condition and uniform break-up length. Conditions were chosen which maximised the satellite free condition and uniform break-up length for each foil thickness.

65 μm foil was found to give optimum results at wavelength 170 to 180 μm giving an operating mean of 175 μm. This compares to a mean operating wavelength of 160 μm for 100 μm foil. This represents a change in jet velocity from 12 m/s to 13.125 m/s. This is a desirable 9% increase in jet velocity with a corresponding improvement in throw. It is believed that the increase in jet velocity with thinner foil is due to improved fluid flow characteristics, e.g. the development of the dynamic flow profile within each orifice.

In the aforedescribed, lower limits on foil thickness of 45 μm and 55 μm are mentioned. The 45 μm limit is due to jet misalignment problems. The 55 μm limit is due to foil resonance problems. It is to be appreciated that it is possible to lower these limits by making refinements in the droplet generator/print head, e.g. better quality welding of foil to nozzle carrier (see earlier), narrowing of foil free width, improvement in electro discharge machining of nozzle orifices to provide better orifice geometry, improving uniformity in flow entering nozzle orifices, and lowering in operating frequency (see FIG. 6).

The droplet generator described above by way of example is one of the specified type designed so that its ink cavity is resonant at operating frequency. It is to be understood that the present invention is also applicable to a droplet generator of the specified type designed so that its actuator is resonant at operating frequency.

What is claimed is:

1. A droplet generator for a continuous stream ink jet print head, comprising:

a) an elongate cavity for containing the ink;

b) nozzle orifices in a wall of said cavity for passing ink from the cavity to form jets, said nozzle orifices extending along the length of the cavity; and c) actuator means disposed on the opposite side of said cavity to said wall for vibrating the ink in the cavity by itself vibrating relative to said wall to break each said jet up into ink droplets at a same predetermined distance from said wall of the cavity, said wall through which the nozzle orifices extend having a thickness less than 90 μm, said wall comprising a planar member secured to a remainder of said droplet generator so as to form a boundary which extends around the nozzle orifices and within which said planar member is unsupported, said boundary including first and second boundary lengths which extend along the length of said cavity on either side of the nozzle orifices, the first and second boundary lengths being spaced by a distance less than 1700 μm.

2. The generator according to claim 1, wherein said distance between said first and second boundary lengths is less than 1350 μm.

3. The generator according to claim 1, wherein said planar member is a planar metallic member.

4. The generator according to claim 3, wherein said planar metallic member is stainless steel foil.

5. The generator according to claim 3, wherein said planar metallic member is secured to the remainder of said droplet generator by means of welding which extends along a path defining said boundary around the nozzle orifices.

6. The generator according to claim 5, wherein the nozzle orifices are electro-discharged machined in the planar metallic member.

7. The generator according to claim 1, wherein said thickness of said wall through which said nozzle orifices extend is greater than 45 μm.

8. The generator according to claim 1, wherein said thickness of said wall through which said nozzle orifices extend is greater than 55 μm.

9. The generator according to claim 1, wherein said thickness of said wall through which said nozzle orifices extend is from 60 to 80 μm.

* * * * *